US011781209B2

(12) United States Patent
Hiraoka

(10) Patent No.: US 11,781,209 B2
(45) Date of Patent: Oct. 10, 2023

(54) SURFACE HARDENING TREATMENT DEVICE AND SURFACE HARDENING TREATMENT METHOD

(71) Applicant: Parker Netsushori Kogyo Co., Ltd., Tokyo (JP)

(72) Inventor: Yasushi Hiraoka, Tokyo (JP)

(73) Assignee: Parker Netsushori Kogyo Co., Ltd., Tokyo (JP)

( * ) Notice: Subject to any disclaimer, the term of this patent is extended or adjusted under 35 U.S.C. 154(b) by 173 days.

(21) Appl. No.: 17/257,119

(22) PCT Filed: Aug. 19, 2019

(86) PCT No.: PCT/JP2019/032264
§ 371 (c)(1),
(2) Date: Dec. 30, 2020

(87) PCT Pub. No.: WO2020/036233
PCT Pub. Date: Feb. 20, 2020

(65) Prior Publication Data

US 2021/0214832 A1 Jul. 15, 2021

(30) Foreign Application Priority Data

Aug. 17, 2018 (JP) ..... 2018-153587

(51) Int. Cl.
*C23C 8/26* (2006.01)
*C23C 8/32* (2006.01)
(Continued)

(52) U.S. Cl.
CPC ..... *C23C 8/26* (2013.01); *C23C 8/32* (2013.01); *F27B 5/04* (2013.01); *F27B 2005/161* (2013.01)

(58) Field of Classification Search
CPC .... C23C 8/24; C23C 8/32; C23C 8/26; C23C 8/28; C21D 1/06
(Continued)

(56) References Cited

U.S. PATENT DOCUMENTS 5,064,173 A * 11/1991 Ecalle ..... C21D 1/76 266/252
11,155,891 B2 * 10/2021 Hiraoka ..... C21D 1/76
(Continued)

FOREIGN PATENT DOCUMENTS

CN 110914467 A 3/2020
EP 3650574 A1 5/2020
(Continued)

OTHER PUBLICATIONS

Extended European search report dated Nov. 5, 2021 regarding PCT/JP2019/032263.
(Continued)

*Primary Examiner* — Jessee R Roe
*Assistant Examiner* — Michael Aboagye
(74) *Attorney, Agent, or Firm* — Renner, Kenner; Arthur M. Reginelli

(57) ABSTRACT

Based on the nitriding potential in the processing furnace calculated by the in-furnace nitriding potential calculator and the target nitriding potential, the introduction amount of the ammonia gas is changed while the introduction amount of the ammonia decomposition gas is kept constant, such that the nitriding potential in the processing furnace is brought close to the target nitriding potential.

5 Claims, 4 Drawing Sheets

(51) Int. Cl.
*F27B 5/04* (2006.01)
*F27B 5/16* (2006.01)

(58) Field of Classification Search
USPC ..... 266/81, 82, 83, 87, 110, 44
See application file for complete search history.

(56) References Cited

U.S. PATENT DOCUMENTS

| | | | | |
|---|---|---|---|---|
| 2006/0138718 | A1 | 6/2006 | Braziunas | 266/80 |
| 2017/0292172 | A1* | 10/2017 | Korwin | C21D 1/76 |
| 2020/0190609 | A1 | 6/2020 | Hiraoka et al. | |

FOREIGN PATENT DOCUMENTS

| | | | |
|---|---|---|---|
| JP | 48-089842 | A | 11/1973 |
| JP | 56-501013 | A | 7/1981 |
| JP | 2007131933 | A | 5/2007 |
| JP | 5629436 | B2 | 11/2014 |
| JP | 2016211069 | A | 12/2016 |
| JP | 2017082275 | A | 5/2017 |
| JP | 6345320 | B1 | 6/2018 |
| KR | 2016-0009504 | A | 1/2016 |
| WO | WO 2016/129333 | A1 | 8/2016 |
| WO | 2019208534 | A1 | 10/2019 |

OTHER PUBLICATIONS

Hiraoka et al.,; *Phase Control of Compound Layer for Gas Nitrided Low Alloy Steel by Using Nitriding Potential Control and Thermodynamic Calculation Methods*; Heat Treatment; vol. 55, No. 1, pp. 7-11; 2015.

Liedtke et al.; *Nitriding and Nitrocarburizing On Iron Materials*; Agune Technical Center; pp. 158-163; 2013.

Hiraoka et al.,; *Effect of Compound Layer Thickness Composed of y'-$Fe_4N$ on Rotated-Bending Fatigue Strength in Gas-Nitrided JIS-SCM435 Steel*; Materials Transactions; vol. 58, No. 7; pp. 993-999; 2017.

International Search Report dated Sep. 10, 2019 in related application No. PCT/JP2019/032264.

Examination Report from Indian Patent Office for Application No. 202147009801 dated Jul. 28, 2022.

Office Action from the Chinese Patent Office dated Sep. 28, 2022 regarding application CN201980050668.8.

* cited by examiner

SURFACE HARDENING TREATMENT DEVICE AND SURFACE HARDENING TREATMENT METHOD

CROSS-REFERENCE TO RELATED APPLICATION

This is a § 371 application of International Patent Application No. PCT/JP2019/032264 filed Aug. 19, 2019, which claims the benefit of Japanese Patent Application No. 2018-153587 filed Aug. 17, 2018.

TECHNICAL FIELD

The present invention relates to a surface hardening treatment device and a surface hardening treatment method which can perform a surface hardening treatment, such as nitriding, nitrocarburizing, nitriding quenching (austenitic nitriding), and the like, for a work made of metal.

BACKGROUND ART

Among various surface hardening treatments for a work made of metal such as steel, there is a strong need for nitriding because it is a low distortion treatment. As a specific nitriding method, there are a gas method, a salt bath method, a plasma method, and the like.

Among these methods, the gas method is comprehensively superior when considering quality, environmental properties, mass productivity, and the like. Carburizing, carbonitriding or induction hardening (quenching) involved in hardening a mechanical part causes distortion, but the distortion can be improved when a nitriding treatment by a gas method (gas nitriding treatment) is used. A nitrocarburizing treatment by a gas method (gas nitrocarburizing treatment) involved in carburizing is also known as a treatment of the same kind as the gas nitriding treatment.

The gas nitriding treatment is a process in which only nitrogen is permeated and diffused into a work, in order to harden a surface of the work. In the gas nitriding treatment, an ammonia gas alone, a mixed gas of an ammonia gas and a nitrogen gas, a mixed gas of an ammonia gas and an ammonia decomposition gas (which consists of 75% hydrogen and 25% nitrogen, and is also called an AX gas), or a mixed gas of an ammonia gas, an ammonia decomposition gas and a nitrogen gas, is introduced into a processing furnace in order to perform a surface hardening treatment.

On the other hand, the gas nitrocarburizing treatment is a process in which carbon is secondarily permeated and diffused into a work together with nitrogen, in order to harden a surface of the work. For example, in the gas nitrocarburizing treatment, a mixed gas of an ammonia gas, a nitrogen gas and a carbon dioxide gas ($CO_2$) or a mixed gas of an ammonia gas, a nitrogen gas, a carbon dioxide gas and a carbon monoxide gas (CO) is introduced into a processing furnace in order to perform a surface hardening treatment, as a plurality of furnace introduction gases.

The basis of an atmosphere control in the gas nitriding treatment and in the gas nitrocarburizing treatment is to control a nitriding potential ($K_N$) in a furnace. By controlling the nitriding potential ($K_N$), it is possible to control a volume fraction of the γ' phase ($Fe_4N$) and the ε phase ($Fe_{2-3}N$) in a compound layer generated on a surface of a steel material and/or to achieve a process in which such a compound layer is not generated. That is to say, it is possible to obtain a wide range of nitriding qualities. For example, according to JP-A-2016-211069 (Patent Document 1), the bending fatigue strength and/or the wear resistance of a mechanical part may be improved by selecting the γ' phase and increasing its thickness, which can achieve a further high functionality of the mechanical part.

In the gas nitriding treatment and the gas nitrocarburizing treatment as described above, in order to control an atmosphere in the processing furnace in which the work is arranged, an in-furnace atmospheric gas concentration measurement sensor configured to measure a hydrogen concentration in the furnace or an ammonia concentration in the furnace is installed. Then, the in-furnace nitriding potential is calculated from the measured value of the in-furnace atmospheric gas concentration measurement sensor, and is compared with a target (set) nitriding potential, in order to control the flow rate of each furnace introduction gas ("Heat Treatment", Volume 55, No. 1, pages 7-11 (Yasushi Hiraoka, Yoichi Watanabe): Non-Patent Document 1). As for the method of controlling each furnace introduction gas, a method of controlling the total amount while keeping the flow rate ratio between the respective furnace introduction gases constant is well known ("Nitriding and Nitrocarburizing on Iron Materials", second edition (2013), pages 158-163 pages (Dieter Liedtke et al., Agune Technical Center): Non-Patent Document 2).

JP-B-5629436 (Patent Document 2) has disclosed a device which can perform both a first control step of controlling a total introduction amount of a plurality of furnace introduction gases while keeping a flow rate ratio between the plurality of furnace introduction gases constant and a second control step of controlling an introduction amount of each of the plurality of furnace introduction gases while changing a flow rate ratio between the plurality of furnace introduction gases (either one of the first control step and the second control step is selectively performed at a time). However, JP-B-5629436 (Patent Document 2) has disclosed only one example of nitriding treatment in which the first control step is effective (paragraphs 0096 and 0099 of JP-B-5629436: the nitriding potential 3.3 is precisely controlled "by controlling the total introduction amount of the ammonia gas and the nitrogen gas while keeping the flow rate ratio of $NH_3$ (ammonia gas):$N_2$ (nitrogen gas)=80:20"), but there is no description as to what kind of nitriding treatment or nitrocarburizing treatment for which the second control step should be adopted. In addition, JP-B-5629436 (Patent Document 2) has disclosed no specific example of the second control step.

The method of controlling a total introduction amount of a plurality of furnace introduction gases while keeping a flow rate ratio between the plurality of furnace introduction gases constant is advantageous in that the total used amount of the plurality of furnace introduction gases may be made smaller. However, it has been known that the controllable range of nitriding potential by means of this method is narrow. In order to cope with this problem, the present inventor has already developed a control method that can achieve a wide controllable range of nitriding potential on the side of lower nitriding potential (for example, about 0.05 to 1.3 at 580° C.) and has obtained JP-B-6345320 (Patent Document 3). According to the control method disclosed in JP-B-6345320 (Patent Document 3), an introduction amount of each of the plurality of furnace introduction gases is controlled by changing a flow rate ratio between the plurality of furnace introduction gases while keeping a total introduction amount of the plurality of furnace introduction gases constant, such that the nitriding potential in the processing furnace is brought close to the target nitriding potential.

(Fundamentals of the Gas Nitriding Treatment)

The fundamentals of the gas nitriding treatment are chemically explained. In the gas nitriding treatment, in the processing furnace (gas nitriding furnace) in which the work is arranged, a nitriding reaction represented by the following formula (1) occurs.

$$NH_3 \rightarrow [N] + 3/2H_2 \quad (1)$$

At this time, the nitriding potential $K_N$ is defined by the following formula (2).

$$K_N = P_{NH3}/P_{H2}^{3/2} \quad (2)$$

Herein, the partial pressure of ammonia in the furnace is represented by $P_{NH3}$, and the partial pressure of hydrogen in the furnace is represented by $P_{H2}$. The nitriding potential $K_N$ is well known as an index representing the nitriding ability of the atmosphere in the gas nitriding furnace.

On the other hand, in the furnace during the gas nitriding treatment, a part of the ammonia gas introduced into the furnace is thermally decomposed into a hydrogen gas and a nitrogen gas according to a reaction represented by the following formula (3).

$$NH_3 \rightarrow 1/2N_2 + 3/2H_2 \quad (3)$$

In the furnace, the thermal decomposition reaction represented by the formula (3) mainly (dominantly) occurs, and the nitriding reaction represented by the formula (1) is almost negligible quantitatively. Therefore, if the in-furnace ammonia concentration consumed in the reaction represented by the formula (3) or the hydrogen gas concentration generated in the reaction represented by the formula (3) is known, the nitriding potential can be calculated. That is to say, since 1.5 mol of hydrogen and 0.5 mol of nitrogen are generated from 1 mol of ammonia, if the in-furnace ammonia concentration is measured, the in-furnace hydrogen concentration can also be known and thus the nitriding potential can be calculated. Alternatively, if the in-furnace hydrogen concentration is measured, the in-furnace ammonia concentration can also be known, and thus the nitriding potential can also be calculated.

The ammonia gas that has been introduced (flown) into the gas nitriding furnace is circulated through the furnace and then discharged outside the furnace. That is to say, in the gas nitriding treatment, a fresh (new) ammonia gas is continuously flown into the furnace with respect to the existing gases in the furnace, so that the existing gases are continuously discharged out of the furnace (extruded at the supply pressure).

Herein, if the flow rate of the ammonia gas introduced into the furnace is small, the gas residence time thereof in the furnace becomes long, so that the amount of the ammonia gas to be thermally decomposed increases, which increases the amount of the sum of the nitrogen gas and the hydrogen gas generated by the thermal decomposition reaction. On the other hand, if the flow rate of the ammonia gas introduced into the furnace is large, the amount of the ammonia gas to be discharged outside the furnace without being thermally decomposed increases, which decreases the amount of the sum of the nitrogen gas and the hydrogen gas generated by the thermal decomposition reaction.

(Fundamentals of the Flow Rate Control)

Next, the fundamentals of the flow rate control are explained in the case wherein an ammonia gas is used as a solo (single) furnace introduction gas. When the degree of thermal decomposition of the ammonia gas introduced into the furnace is represented by s ($0<s<1$), the gas reaction in the furnace is represented by the following formula (4).

$$NH_3 \rightarrow (1-s)/(1+s)NH_3 + 0.5s/(1+s)N_2 + 1.5s/(1+s)H_2 \quad (4)$$

Herein, the left side represents the furnace introduction gas (ammonia gas only), the right side represents the in-furnace atmospheric gases (gas composition) including a part of the ammonia gas remained without being thermally decomposed, and the nitrogen gas and the hydrogen gas generated in the ratio of 1:3 by the thermal decomposition of the ammonia gas. Therefore, when the hydrogen concentration in the furnace is measured by means of a hydrogen sensor, 1.5s/(1+s) on the right side corresponds to the measured value of the hydrogen sensor, and thus the degree of the thermal decomposition s of the ammonia gas introduced into the furnace can be calculated from the measured value. Thereby, the ammonia concentration in the furnace corresponding to (1−s)/(1+s) on the right side can also be calculated. That is to say, the in-furnace hydrogen concentration and the in-furnace ammonia concentration can be known only from the measured value of the hydrogen sensor. Thus, the nitriding potential can be calculated.

Similarly, even when a plurality of furnace introduction gases are used, it is possible to control the nitriding potential $K_N$. For example, when an ammonia gas and a nitrogen gas are used as two furnace introduction gases and the introduction ratio therebetween is x:y (both x and y are known, and x+y=1, For example, if x=0.5, y=1−0.5=0.5 ($NH_3$:$N_2$=1:1), the gas reaction in the furnace is represented by the following formula (5).

$$xNH_3 + (1-x)N_2 \rightarrow x(1-s)/(1+sx)NH_3 + (0.5sx+1-x)/(1+sx)N_2 + 1.5sx/(1+sx)H_2 \quad (5)$$

Herein, the right side represents the in-furnace atmospheric gases (gas composition) including a part of the ammonia gas remained without being thermally decomposed, the nitrogen gas and the hydrogen gas generated in the ratio of 1:3 by the thermal decomposition of the ammonia gas, and the nitrogen gas remained as introduced on the left side (without being decomposed in the furnace). Now, in the hydrogen concentration on the right side, i.e., 1.5sx/(1+sx), x is known (for example, x=0.5), and thus only the degree of the thermal decomposition s of the ammonia gas introduced into the furnace is unknown. Therefore, in the same way as in the formula (4), the degree of the thermal decomposition s of the ammonia gas introduced into the furnace can be calculated from the measured value of the hydrogen sensor. Thereby, the ammonia concentration in the furnace can also be calculated. Thus, the nitriding potential can be calculated.

When the introduction ratio between the respective furnace introduction gases is not fixed, the in-furnace hydrogen concentration and the in-furnace ammonia concentration include two variables, i.e., the degree of the thermal decompositions of the ammonia gas introduced into the furnace and the introduction ratio x of the ammonia gas. In general, a mass flow controller (MFC) is used as a device for controlling each gas flow rate. Thus, the introduction ratio x of the ammonia gas can be continuously read out as a digital signal based on flow rate values of the respective gases. Therefore, the nitriding potential can be calculated based on the formula (5) by combining this introduction ratio x and the measured value of the hydrogen sensor.

Patent Document

The Patent Document 1 cited in the present specification is JP-A-2016-211069.

The Patent Document 2 cited in the present specification is JP-B-5629436.

The Patent Document 3 cited in the present specification is JP-B-6345320.

Non-Patent Document

The Non-patent Document 1 cited in the present specification is "Heat Treatment", Volume 55, No. 1, pages 7-11 (Yasushi Hiraoka, Yoichi Watanabe).

The Non-patent Document 2 cited in the present specification is "Nitriding and Nitrocarburizing on Iron Materials", second edition (2013), pages 158-163 pages (Dieter Liedtke et al., Agune Technical Center).

The Non-patent Document 3 cited in the present specification is "Effect of Compound Layer Thickness Composed of γ'-$Fe_4N$ on Rotated-Bending Fatigue Strength in Gas-Nitrided JIS-SCM435 Steel", Materials Transactions, Vol. 58, No. 7 (2017), pages 993-999 (Y. Hiraoka and A. Ishida).

SUMMARY OF INVENTION

Technical Problem

As described above, the control method disclosed in JP-B-6345320 (Patent Document 3) can achieve a wide controllable range of nitriding potential on the side of lower nitriding potential (for example, about 0.05 to 1.3 at 580° C.), and thus the control method is very useful.

However, in this control method, a flow rate ratio between the plurality of furnace introduction gases is changed while a total introduction amount of the plurality of furnace introduction gases is kept constant, such that the nitriding potential in the processing furnace is brought close to the target nitriding potential. Thus, even when only an ammonia gas and an ammonia decomposition gas are used as the plurality of furnace introduction gases, it is necessary to finely change (fluctuate) a flow rate ratio between these two furnace introduction gases. To that end, in general, a mass flow controller for controlling an introduction amount of the ammonia gas and another mass flow controller for controlling an introduction amount of the ammonia decomposition gas are necessary.

The present inventor has repeated diligent examination and various experiments about the nitriding treatment in which only an ammonia gas and an ammonia decomposition gas are used as the plurality of furnace introduction gases. As a result, the present inventor has found that a control of nitriding potential which is sufficient for practical use can be achieved by finely change (fluctuate) only an introduction amount of the ammonia gas while keeping an introduction amount of the ammonia decomposition gas constant, as a control for bringing the nitriding potential in the processing furnace close to the target nitriding potential.

According to this control, it is not necessary to finely feedback control an introduction amount of the ammonia decomposition gas. That is to say, it is not necessary to provide a mass flow controller for controlling an introduction amount of the ammonia decomposition gas. Thus, the costs related to this element can be saved.

The present invention has been made based on the above findings. It is an object of the present invention to provide a surface hardening treatment device and a surface hardening treatment method which are capable of achieving a control of nitriding potential which is sufficient for practical use, when only an ammonia gas and an ammonia decomposition gas are used as a plurality of furnace introduction gases.

Solution to Problem

The present invention is a surface hardening treatment device for performing a gas nitriding treatment as a surface hardening treatment for a work arranged in a processing furnace by introducing an ammonia gas and an ammonia decomposition gas, the surface hardening treatment device including: an in-furnace atmospheric gas concentration detector configured to detect a hydrogen concentration or an ammonia concentration in the processing furnace; an in-furnace nitriding potential calculator configured to calculate a nitriding potential in the processing furnace based on the hydrogen concentration or the ammonia concentration detected by the in-furnace atmospheric gas concentration detector; and a gas-introduction-amount controller configured to change an introduction amount of the ammonia gas while keeping an introduction amount of the ammonia decomposition gas constant, based on the nitriding potential in the processing furnace calculated by the in-furnace nitriding potential calculator and a target nitriding potential, such that the nitriding potential in the processing furnace is brought close to the target nitriding potential.

According to the present invention, an introduction amount of the ammonia gas is changed while an introduction amount of the ammonia decomposition gas is kept constant, so that a feedback control is achieved in which the nitriding potential in the processing furnace is brought close to the target nitriding potential. Thus, it is not necessary to finely feedback control an introduction amount of the ammonia decomposition gas. That is to say, it is not necessary to provide a mass flow controller for controlling an introduction amount of the ammonia decomposition gas. Thus, the costs related to this element can be saved.

An introduction amount of the ammonia decomposition gas, which is kept constant, and an initial introduction amount of the ammonia gas, which is subsequently changed, are determined based on the target nitriding potential, taking into consideration the relationship of the above formula (2). Specifically, for example, when an introduction amount of the ammonia decomposition gas is provisionally determined as 10 [l/min] and an initial introduction amount of the ammonia gas is provisionally determined as 25 [l/min], an introduction amount of the hydrogen gas among the ammonia decomposition gas is 7.5 [l/min]. Then, when these values are inputted in the right side of the above formula (2), the following figure is calculated.

$$(25/(25+10))/(7.5/(25+10))^{3/2}=7.2$$

If this FIG. 7.2) is larger than the target nitriding potential, the above provisionally determined values can be adopted. However, in fact, the degree of the thermal decomposition of the ammonia gas may be influenced by in-furnace environment of the furnace to be used. Thus, it is desirable to perform a preliminary experiment before each practical operation in order to determine an introduction amount of the ammonia decomposition gas, which is kept constant, and an initial introduction amount of the ammonia gas, which is subsequently changed.

It has also been known that it is desirable to change the target nitriding potential during the process for the same work ("Effect of Compound Layer Thickness Composed of γ'-$Fe_4N$ on Rotated-Bending Fatigue Strength in Gas-Nitrided JIS-SCM435 Steel", Materials Transactions, Vol. 58, No. 7 (2017), pages 993-999 (Y. Hiraoka and A. Ishida): Non-Patent Document 3). In the present invention as well, it is preferable that the target nitriding potential is set to be different values between time zones for the same work.

According to this feature, it is possible to perform a plurality of kinds of surface hardening treatments for the same work. For example, it is possible to perform a treatment for thickening a compound layer (in which the nitriding potential is 1.5 or more at about 580° C.) and another treatment for selectively forming a γ' phase on a steel surface (in which the nitriding potential is within a range of 0.1 to 0.6 at about 580° C.) for the same work in an appropriate order.

In addition, in the present invention, it is preferable that the introduction amount of the ammonia gas is changed by means of a mass flow controller, and that the introduction amount of the ammonia decomposition gas is changed by means of a manual flow meter.

According to this feature, it is sufficient to equip with only one mass flow controller, which is relatively expensive. This can save the costs related to the other mass flow controller that is no longer needed.

In addition, the present invention is a surface hardening treatment method of performing a gas nitriding treatment or a gas nitrocarburizing treatment as a surface hardening treatment for a work arranged in a processing furnace by introducing an ammonia gas and an ammonia decomposition gas, the surface hardening treatment method including: an in-furnace atmospheric gas concentration detecting step of detecting a hydrogen concentration or an ammonia concentration in the processing furnace; an in-furnace nitriding potential calculating step of calculating a nitriding potential in the processing furnace based on the hydrogen concentration or the ammonia concentration detected at the in-furnace atmospheric gas concentration detecting step; and a gas-introduction-amount controlling step of changing an introduction amount of the ammonia gas while keeping an introduction amount of the ammonia decomposition gas constant, based on the nitriding potential in the processing furnace calculated at the in-furnace nitriding potential calculating step and a target nitriding potential, such that the nitriding potential in the processing furnace is brought close to the target nitriding potential.

Effects of Invention

According to the present invention, an introduction amount of the ammonia gas is changed while an introduction amount of the ammonia decomposition gas is kept constant, so that a feedback control is achieved in which the nitriding potential in the processing furnace is brought close to the target nitriding potential. Thus, it is not necessary to finely feedback control an introduction amount of the ammonia decomposition gas. That is to say, it is not necessary to provide a mass flow controller for controlling an introduction amount of the ammonia decomposition gas. Thus, the costs related to this element can be saved.

DESCRIPTION OF EMBODIMENTS

Hereinafter, a preferable embodiment of the present invention will be described. However, the present invention is not limited to the embodiment.

(Structure)

Figure 1:
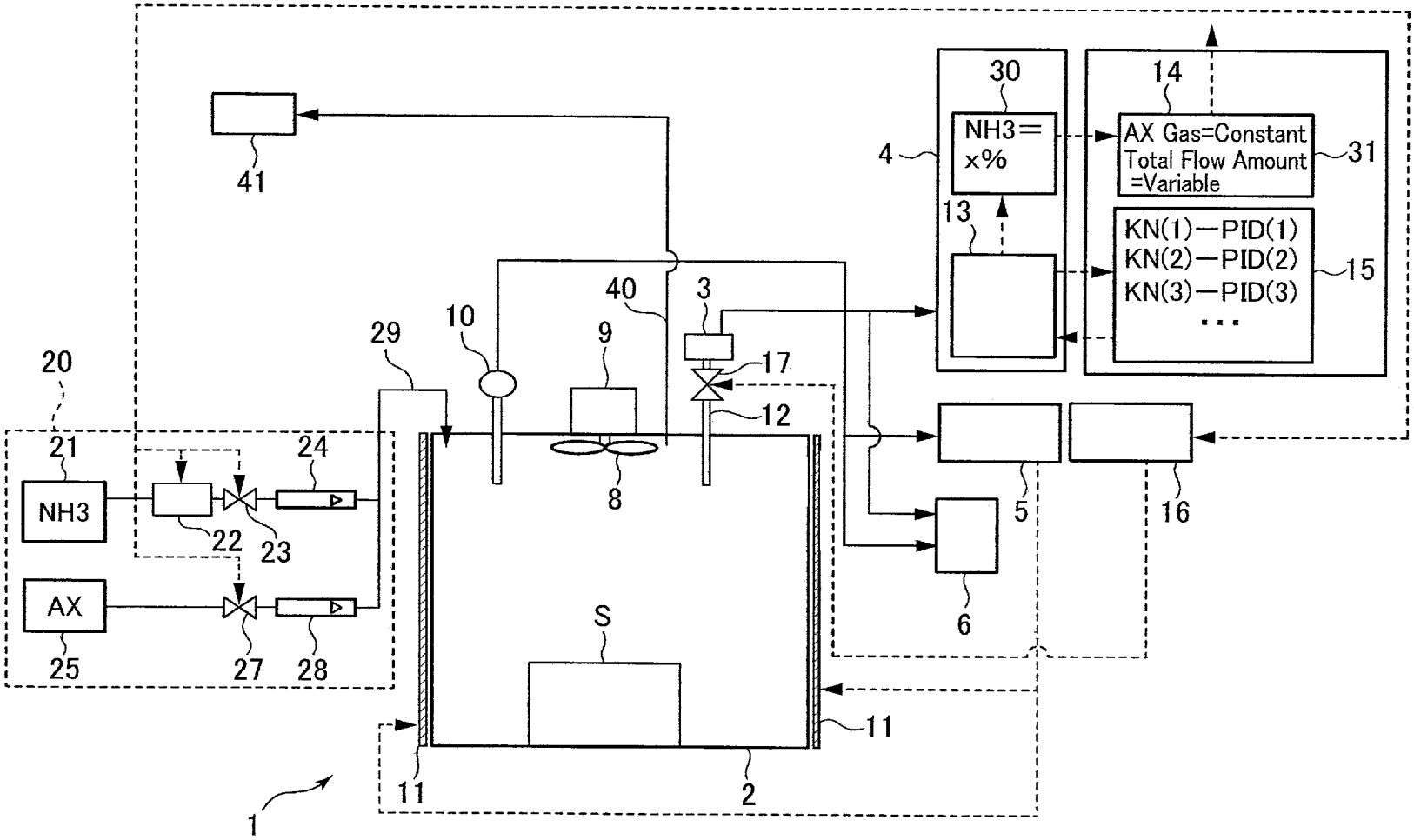
FIG. 1 is a schematic view showing a surface hardening treatment device according to an embodiment of the present invention.

FIG. 1 is a schematic view showing a surface hardening treatment device according to an embodiment of the present invention. As shown in FIG. 1, the surface hardening treatment device 1 of the present embodiment is a surface hardening treatment device for performing a gas nitriding treatment as a surface hardening treatment for a work S arranged in a processing furnace 2 by introducing only two kinds of furnace introduction gases, i.e., only an ammonia gas and an ammonia decomposition gas, into the processing furnace 2.

The ammonia decomposition gas is a gas called AX gas, and is a mixed gas composed of nitrogen and hydrogen in a ratio of 1:3. The work S is made of metal. For example, the work S is a steel part or a mold.

As shown in FIG. 1, the processing furnace 2 of the surface hardening treatment device 1 of the present embodiment includes: a stirring fan 8, a stirring-fan drive motor 9, a in-furnace temperature measuring device 10, a furnace body heater 11, an atmospheric gas concentration detector 3, a nitriding potential adjustor 4, a temperature adjustor 5, a programmable logic controller 31, a recorder 6, and a furnace introduction gas supplier 20.

The stirring fan 8 is disposed in the processing furnace 2 and configured to rotate in the processing furnace 2 in order to stir atmospheric gases in the processing furnace 2. The stirring-fan drive motor 9 is connected to the stirring fan 8 and configured to cause the stirring fan 8 to rotate at an arbitrary rotation speed.

The in-furnace temperature measuring device 10 includes a thermocouple and is configured to measure a temperature of the in-furnace gases existing in the processing furnace 2. In addition, after measuring the temperature of the in-furnace gases, the in-furnace temperature measuring device 10 is configured to output an information signal including the measured temperature (in-furnace temperature signal) to the temperature adjustor 5 and the recorder 6.

The atmospheric gas concentration detector 3 is composed of a sensor capable of detecting a hydrogen concentration or an ammonia concentration in the processing furnace 2 as an in-furnace atmospheric gas concentration. A main body of the sensor communicates with an inside of the processing furnace 2 via an atmospheric gas pipe 12. In the present embodiment, the atmospheric gas pipe 12 is formed as a single-line path that directly communicates the sensor main body of the atmospheric gas concentration detector 3 and the processing furnace 2. An on-off valve 17 is provided in the middle of the atmospheric gas pipe 12, and configured to be controlled by an on-off valve controller 16.

In addition, after detecting the in-furnace atmospheric gas concentration, the atmospheric gas concentration detector 3 is configured to output an information signal including the detected concentration to the nitriding potential adjustor 4 and the recorder 6.

The recorder 6 includes a CPU and a storage medium such as a memory. Based on the signals outputted from the in-furnace temperature measurement device 10 and the atmospheric gas concentration detector 3, the recorder 6 is configured to record the temperature and/or the atmospheric gas concentration in the processing furnace 2, for example in correspondence with the date and time when the surface hardening treatment is performed.

The nitriding potential adjuster 4 includes an in-furnace nitriding potential calculator 13 and a gas flow rate output adjustor 30. The programmable logic controller 31 includes a gas introduction controller 14 and a parameter setting device 15.

The in-furnace nitriding potential calculator 13 is configured to calculate a nitriding potential in the processing furnace 2 based on the hydrogen concentration or the ammonia concentration detected by the atmospheric gas concentration detector 3. Specifically, calculation formulas for the nitriding potential are programmed dependent on the actual furnace introduction gases in accordance with the same theory as the above formula (5), and incorporated in the in-furnace nitriding potential calculator 13, so that the nitriding potential is calculated from the value of the in-furnace atmospheric gas concentration.

For example, the parameter setting device 15 is composed of a touch panel. Through the parameter setting device 15, the target nitriding potential can be set and inputted to be different values depending on time zones for the same work. In addition, through the parameter setting device 15, setting parameter values for a PID control method can be set and inputted for each different value of the target nitriding potential. Specifically, "a proportional gain", "an integral gain or an integration time", and "a differential gain or a differentiation time" for the PID control method can be set and inputted for each different value of the target nitriding potential. The set and inputted setting parameter values are transferred to the gas flow rate output adjustor 30.

The gas flow rate output adjustor 30 is configured to perform the PD control method in which respective gas introduction amounts of the two kinds of furnace introduction gases are input values, the nitriding potential calculated by the in-furnace nitriding potential calculator 13 is an output value, and the target nitriding potential (the set nitriding potential) is a target value. More specifically, in the present PID control method, the nitriding potential in the processing furnace 2 is brought close to the target nitriding potential by changing an introduction amount of the ammonia gas while keeping an introduction amount of the ammonia decomposition gas constant. In addition, in the present PID control method, the setting parameter values that have been transferred from the parameter setting device 15 are used.

Before the setting and inputting operation against the parameter setting device 15, it is preferable to perform pilot processes to obtain in advance candidate values for the setting parameter values of the PID control method. According to the present embodiment, even if (1) a state of the processing furnace (a state of a furnace wall and/or a jig), (2) a temperature condition of the processing furnace and (3) a state of the work (type and/or the number of parts) are the same, it is possible to obtain in advance candidate values for the setting parameter values (4) for each different value of the target nitriding potential, by an auto-tuning function that the nitriding potential adjustor 4 has in itself. In order to embody the nitriding potential adjustor 4 having such an auto-tuning function, a "UT75A" manufactured by Yokogawa Electric Co., Ltd. (a high-functional digital indicating controller, http://www.yokogawa.co.jp/ns/cis/utup/utadvanced/ns-ut75a-01-ja.htm) or the like can be used.

The setting parameter values (a set of "the proportional gain", "the integral gain or the integration time" and "the derivative gain or the derivative time") obtained as the candidate values can be recorded in some manner, and then can be manually inputted to the parameter setting device 15. Alternatively, the setting parameter values obtained as the candidate values can be stored in some storage device in a manner associated with the target nitriding potential, and then can be automatically read out by the parameter setting device 15 based on the set and inputted value of the target nitriding potential.

Before performing the PID control method, the gas flow rate output adjustor 30 is configured to determine an introduction amount of the ammonia decomposition gas, which is kept constant, and an initial introduction amount of the ammonia gas, which is subsequently changed. It is preferable to perform pilot processes to obtain in advance candidate values for these introduction amounts, so that the obtained values can be automatically read out by the parameter setting device 15 from some storage device or can be manually inputted to the parameter setting device 15. Thereafter, according to the PID control method, the introduction amount of the ammonia gas is changed (while the introduction amount of the ammonia decomposition gas is kept constant) such that the nitriding potential in the processing furnace 2 is brought close to the target nitriding potential. Then, the output values from the gas flow rate output adjustor 30 are transferred to the gas introduction amount controller 14.

The gas introduction amount controller 14 is configured to transmit a control signal to a first supply amount controller 22 for the ammonia gas.

The furnace introduction gas supplier 20 of the present embodiment includes a first furnace introduction gas supplier 21 for the ammonia gas, the first supply amount controller 22, a first supply valve 23 and a first flow meter 24. In addition, the furnace introduction gas supplier 20 of the present embodiment includes a second furnace introduction gas supplier 25 for the ammonia decomposition gas (AX gas), the second supply valve 27 and a second flow meter 28.

In the present embodiment, the ammonia gas and the ammonia decomposition gas are mixed in a furnace introduction gas pipe 29 before entering the processing furnace 2.

The first furnace introduction gas supplier 21 is formed by, for example, a tank filled with a first furnace introduction gas (in this example, the ammonia gas).

The first supply amount controller 22 is formed by a mass flow controller (which can finely change a flow rate within a short time period), and is interposed between the first furnace introduction gas supplier 21 and the first supply valve 23. An opening degree of the first supply amount controller 22 changes according to the control signal outputted from the gas introduction amount controller 14. In addition, the first supply amount controller 22 is configured to detect a supply amount from the first furnace introduction gas supplier 21 to the first supply valve 23, and output an information signal including the detected supply amount to the gas introduction amount controller 14 and the recorder 6. This information signal can be used for correction or the like of the control performed by the gas introduction amount controller 14.

The first supply valve 23 is formed by an electromagnetic valve configured to switch between opened and closed states according to a control signal outputted from the gas introduction amount controller 14, and is interposed between the first supply amount controller 22 and the first flow meter 24.

The first flow meter 24 is formed by, for example, a mechanical flow meter such as a flow-type flow meter, and is interposed between the first supply valve 23 and the furnace introduction gas pipe 29. The first flow meter 24 detects a supply amount from the first supply valve 23 to the furnace introduction gas pipe 29. The supply amount detected by the first flow meter 24 can be provided for an operator's visual confirmation.

The second furnace introduction gas supplier 25 is formed by, for example, a tank filled with a second furnace introduction gas (in this example, the ammonia decomposition gas).

The second supply valve 27 is formed by an electromagnetic valve configured to switch between opened and closed states according to a control signal outputted from the gas introduction amount controller 14, and is interposed between the second furnace introduction gas supplier 25 and the second flow meter 28.

The second flow meter 28 is formed by, for example, a mechanical manual flow meter such as a flow-type flow meter (which cannot finely change a flow rate within a short time period), and is interposed between the second supply valve 27 and the furnace introduction gas pipe 29. The second flow meter 28 can adjust a supply amount from the second supply valve 27 to the furnace introduction gas pipe 29 and can detect an actual supply amount thereof. The flow rate (opening degree) of the second flow meter 28 is manually adjusted so as to correspond to the control signal outputted from the gas introduction amount controller 14. The actual supply amount detected by the second flow meter 28 can be provided for an operator's visual confirmation.

(Operation)

Figure 2:
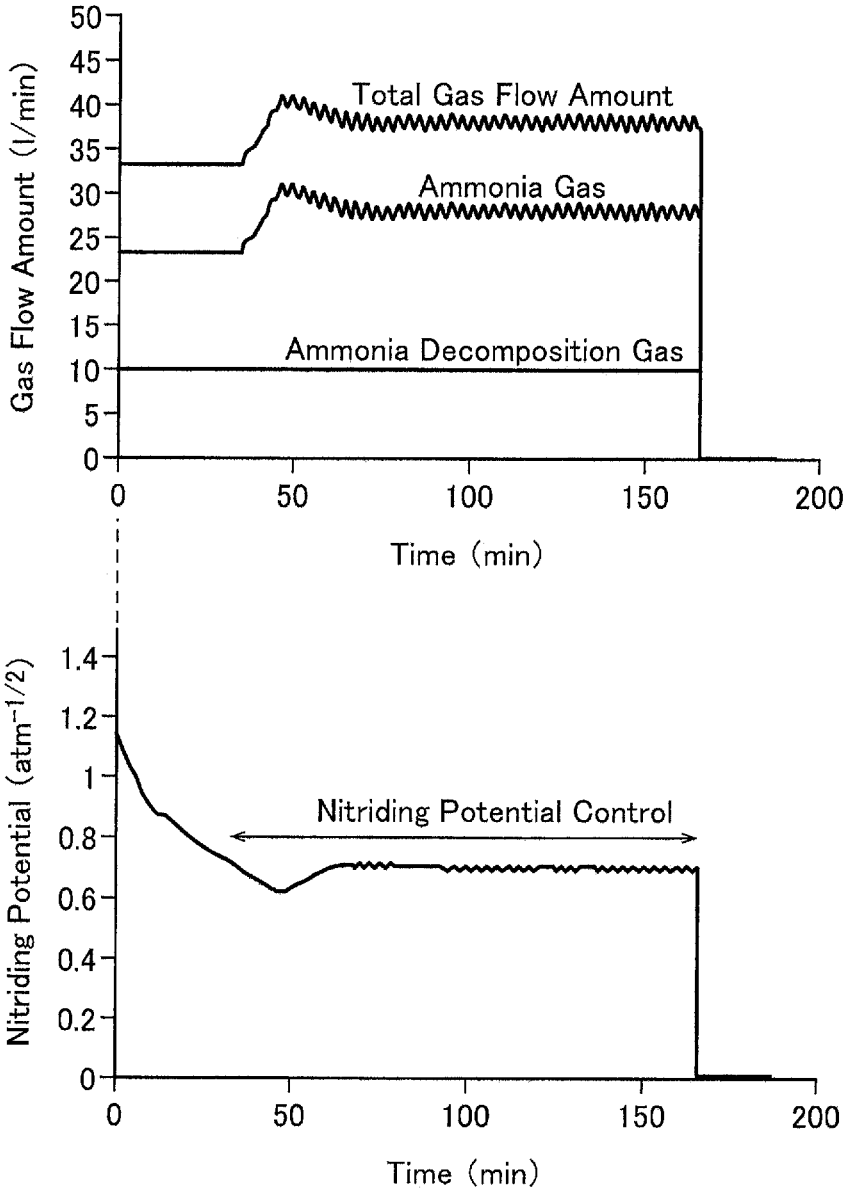
FIG. 2 is a table showing results of nitriding potential controls as examples.

Next, with reference to FIG. 2, an operation of the surface hardening treatment device 1 according to the present embodiment is explained. First, a work S to be processed is put into the processing furnace 2, and then the processing furnace 2 starts to be heated. In the example shown in FIG. 2, a pit furnace having a size of φ 700×1000 was used as the processing furnace 2, 570° C. was adopted as the temperature to be heated, and a steel material having a surface area of 4 $m^2$ was used as the work S.

While the processing furnace 2 is heated, the ammonia gas and the ammonia decomposition gas are introduced into the processing furnace 2 from the furnace introduction gas supplier 20 according to their respective initial introduction amounts. In this example, as shown in FIG. 2, the initial introduction amount of the ammonia gas was set to 23 [l/min] and the initial introduction amount of the ammonia decomposition gas was set to 10 [l/min]. These initial introduction amounts can be set and inputted by the parameter setting device 15. Furthermore, the stirring fan drive motor 9 is driven and thus the stirring fan 8 rotates to stir the atmospheric gases in the processing furnace 2.

In the initial state, the on-off valve controller 16 closes the on-off valve 17. In general, as a pretreatment for the gas nitriding treatment, a treatment for activating a steel surface to make it easy for nitrogen to enter may be performed. In this case, a hydrogen chloride gas and/or a hydrogen cyanide gas or the like may be generated in the furnace. These gases may deteriorate the atmospheric gas concentration detector (sensor) 3, and thus it is effective to keep the on-off valve 17 closed.

In addition, the in-furnace temperature measurement device 10 measures a temperature of the in-furnace gases, and outputs an information signal including the measured temperature to the nitriding potential adjustor 4 and the recorder 6. The nitriding potential adjustor 4 judges whether the state in the processing furnace 2 is still during the temperature rising step or already after the temperature rising step has been completed (a stable state).

In addition, the in-furnace nitriding potential calculator 13 of the nitriding potential adjustor 4 calculates an in-furnace nitriding potential (which is initially an extremely high value (since no hydrogen gas exists in the furnace), but decreases as decomposition of the ammonia gas (generation of the hydrogen gas) proceeds) and judges whether the calculated value has dropped lower than the sum of the target nitriding potential (0.7 in the example shown in FIG. 2) and a standard margin. This standard margin can also be set and inputted by the parameter setting device 15, and is for example 0.1.

When it is determined that the temperature rising step has been completed and also it is determined that the calculated value of the in-furnace nitriding potential has dropped lower than the sum (0.8 in the example shown in FIG. 2) of the target nitriding potential and the standard margin (at a timing of about 35 minutes after starting the treatment in the example shown in FIG. 2), the nitriding potential adjustor 4 starts to control an introduction amount of each of the furnace introduction gases via the gas introduction amount controller 14. Herein, the on-off valve controller 16 opens the on-off valve 17.

When the on-off valve 17 is opened, the processing furnace 2 and the atmospheric gas concentration detector 3 communicate with each other, and then the atmospheric gas concentration detector 3 detects an in-furnace hydrogen concentration or an in-furnace ammonia concentration. The detected hydrogen concentration signal or ammonia concentration signal is outputted to the nitriding potential adjustor 4 and the recorder 6.

The in-furnace nitriding potential calculator 13 of the nitriding potential adjustor 4 calculates the in-furnace nitriding potential based on the inputted hydrogen concentration signal or ammonia concentration signal. Then, the gas flow rate output adjustor 30 performs the PID control method in which the respective gas introduction amounts of the two kinds of furnace introduction gases are input values, the nitriding potential calculated by the in-furnace nitriding potential calculator 13 is an output value, and the target nitriding potential (the set nitriding potential) is a target value. Specifically, in the present PID control method, the nitriding potential in the processing furnace 2 is brought close to the target nitriding potential by changing the introduction amount of the ammonia gas while keeping the introduction amount of the ammonia decomposition gas constant. In the present PID control method, the setting parameter values that have been set and inputted by the parameter setting device 15 are used. The setting parameter values may be different depending on values of the target nitriding potential.

Then, the gas flow rate output adjustor 30 controls the introduction amount of the ammonia gas as a result of the PID control method. Specifically, the gas flow rate output adjustor 30 determines the introduction amount of the ammonia gas, and the output value from the gas flow rate output adjustor 30 is transferred to the gas introduction amount controller 14.

The gas introduction amount controller 14 transmits a control signal to the first supply amount controller 22 for the ammonia gas in order to realize the determined introduction amount of the ammonia gas.

According to the control as described above, the in-furnace nitriding potential can be stably controlled in the vicinity of the target nitriding potential. Thereby, the surface hardening treatment of the work S can be performed with extremely high quality. As a specific example, in the example shown in FIG. 2, a feedback control is performed with a sampling rate of about several hundred milliseconds, and the introduction amount of the ammonia gas is increased and decreased within a range of about 2 ml (±1 ml), so that the nitriding potential can be controlled to the target nitriding potential (0.7) with extremely high precision since a timing of about 60 minutes after starting the treatment. (In the example shown in FIG. 2, recording of the respective gas introduction amounts and the nitriding potential was stopped at a timing of about 170 minutes after starting the treatment.)

(Structure of Comparative Example)

Figure 3:
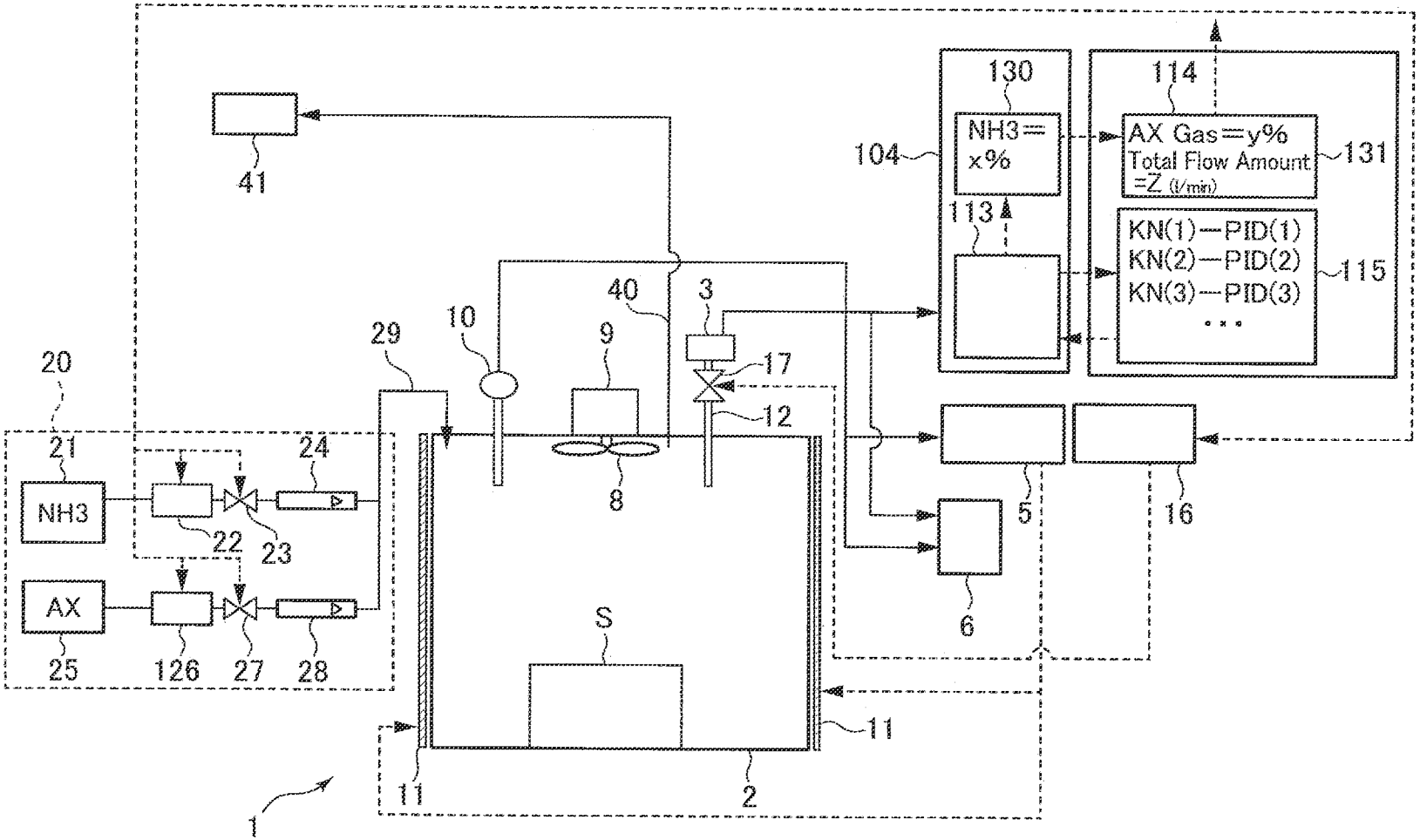
PRIOR ART FIG.3
FIG. 3 is a schematic view showing a surface hardening treatment device according to the invention disclosed in JP-B-6345320 (Patent Document 3)

FIG. 3 is a schematic view showing a surface hardening treatment device according to the invention disclosed in JP-B-6345320 (Patent Document 3);

In the surface hardening treatment device shown in FIG. 3, there is provided a second supply amount controller 126, which is another mass flow controller, between the second furnace introduction gas supplier 25 and the second supply valve 27. A gas flow rate output adjustor 130 is configured to perform a PID control method, in which the nitriding potential in the processing furnace 2 is brought close to the target nitriding potential by changing a flow rate ratio between the ammonia gas and the ammonia decomposition gas while keeping a total introduction amount of the ammonia gas and the ammonia decomposition gas constant.

The gas flow rate output adjustor 130 is configured to control the introduction amount of each of the furnace introduction gases as a result of the PID control method. Specifically, the gas flow rate output adjustor 130 determines a flow rate ratio of the ammonia gas as a value within 0 to 100%, or a flow rate ratio of the ammonia decomposition gas as a value within 0 to 100%. In any case, since the sum of the two flow rate ratios is 100%, when one flow rate ratio is determined, the other flow rate ratio is also determined. Then, the output values from the gas flow rate output adjustor 130 are transferred to a gas introduction amount controller 114.

The gas introduction amount controller 114 is configured to transmit control signals to the first supply amount controller 22 for the ammonia gas and a second supply amount controller 126 for the ammonia decomposition gas, respectively, in order to realize an introduction amount of each gas corresponding to the total introduction amount (total flow rate)×the flow rate ratio of each gas. In the present embodiment, the total introduction amount of the respective gases can also be set and inputted by a parameter setting device 115 for each different value of the target nitriding potential.

The other structure of the treatment device shown in FIG. 3 is substantially the same as the treatment device according to the embodiment of the invention explained with reference to FIG. 1. In FIG. 3, the same portions as those of the treatment device shown in FIG. 1 are shown by the same reference numerals, and detailed explanation thereof is omitted.

(Operation of Comparative Example)

Figure 4:
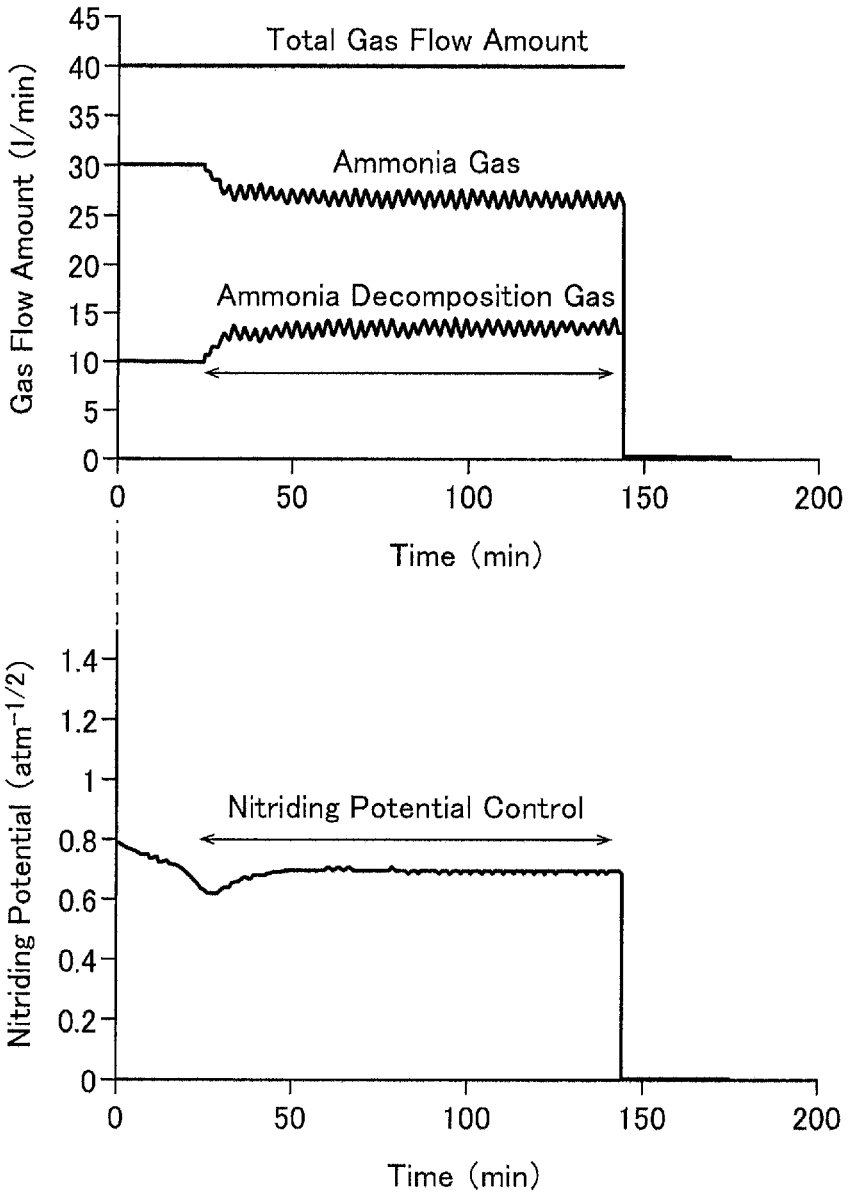
FIG. 4 is a table showing results of nitriding potential controls as comparative examples.

Next, with reference to FIG. 4, an operation of the surface hardening treatment device shown in FIG. 3 is explained. First, a work S to be processed is put into the processing furnace 2, and then the processing furnace 2 starts to be heated. In the example shown in FIG. 4 as well, a pit furnace having a size of φ 700×1000 was used as the processing furnace 2, 570° C. was adopted as the temperature to be heated, and a steel material having a surface area of 4 $m^2$ was used as the work S.

While the processing furnace 2 is heated, the ammonia gas and the ammonia decomposition gas are introduced into the processing furnace 2 from the furnace introduction gas supplier 20 according to their respective initial introduction amounts. In this example, as shown in FIG. 4, the initial introduction amount of the ammonia gas was set to 30 [l/min] and the initial introduction amount of the ammonia decomposition gas was set to 10 [l/min]. These initial introduction amounts can be set and inputted by the parameter setting device 115. Furthermore, the stirring fan drive motor 9 is driven and thus the stirring fan 8 rotates to stir the atmospheric gases in the processing furnace 2.

In this comparative example as well, in the initial state, the on-off valve controller 16 closes the on-off valve 17. In general, as a pretreatment for the gas nitriding treatment, a treatment for activating a steel surface to make it easy for nitrogen to enter may be performed. In this case, a hydrogen chloride gas and/or a hydrogen cyanide gas or the like may be generated in the furnace. These gases may deteriorate the atmospheric gas concentration detector (sensor) 3, and thus it is effective to keep the on-off valve 17 closed.

In addition, the in-furnace temperature measurement device 10 measures a temperature of the in-furnace gases, and outputs an information signal including the measured temperature to the nitriding potential adjustor 4 and the recorder 6. The nitriding potential adjustor 4 judges whether the state in the processing furnace 2 is still during the temperature rising step or already after the temperature rising step has been completed (a stable state).

In addition, the in-furnace nitriding potential calculator 113 of the nitriding potential adjustor 4 calculates an in-furnace nitriding potential (which is initially a high value (since no hydrogen gas exists in the furnace), but decreases as decomposition of the ammonia gas (generation of the hydrogen gas) proceeds) and judges whether the calculated value has dropped lower than the sum of the target nitriding potential (0.7 in the example shown in FIG. 4) and a standard margin. This standard margin can also be set and inputted by the parameter setting device 115, and is for example 0.1.

When it is determined that the temperature rising step has been completed and also it is determined that the calculated value of the in-furnace nitriding potential has dropped lower than the sum (0.8 in the example shown in FIG. 4) of the target nitriding potential and the standard margin (at a timing of about 25 minutes after starting the treatment in the example shown in FIG. 4), the nitriding potential adjustor 4 starts to control an introduction amount of each of the furnace introduction gases via the gas introduction amount controller 114. Herein, the on-off valve controller 16 opens the on-off valve 17.

When the on-off valve 17 is opened, the processing furnace 2 and the atmospheric gas concentration detector 3 communicate with each other, and then the atmospheric gas concentration detector 3 detects an in-furnace hydrogen concentration or an in-furnace ammonia concentration. The detected hydrogen concentration signal or ammonia concentration signal is outputted to the nitriding potential adjustor 4 and the recorder 6.

The in-furnace nitriding potential calculator 113 of the nitriding potential adjustor 4 calculates the in-furnace nitriding potential based on the inputted hydrogen concentration signal or ammonia concentration signal. Then, the gas flow rate output adjustor 30 performs the PID control method in which the respective gas introduction amounts of the two kinds of furnace introduction gases are input values, the nitriding potential calculated by the in-furnace nitriding potential calculator 113 is an output value, and the target nitriding potential (the set nitriding potential) is a target value. Specifically, in the present PID control method, the nitriding potential in the processing furnace 2 is brought close to the target nitriding potential by changing the flow rate ratio between the ammonia gas and the ammonia decomposition gas while keeping the total introduction amount of the ammonia gas and the ammonia decomposition gas constant. by changing the introduction amount of the ammonia gas while keeping the introduction amount of the ammonia decomposition gas constant. In the present PID control method, the setting parameter values that have been set and inputted by the parameter setting device 115 are used. The setting parameter values may be different depending on values of the target nitriding potential.

Then, the gas flow rate output adjustor 130 controls the introduction amount of each of the plurality of furnace introduction gases as a result of the PID control method. Specifically, the gas flow rate output adjustor 130 determines a flow rate ratio of each of the ammonia gas and the ammonia decomposition gas as a value within 0 to 100%, and the output values from the gas flow rate output adjustor 130 are transferred to the gas introduction amount controller 114.

The gas introduction amount controller 114 transmits control signals to the first supply amount controller 22 for the ammonia gas and a second supply amount controller 126 for the ammonia decomposition gas, respectively, in order to realize an introduction amount of each gas corresponding to the total introduction amount×the flow rate ratio of each gas.

target nitriding potential is set to 0.7, the treatment device shown in FIG. 1 (the embodiment of the invention) can achieve as high a control precision as the treatment device shown in FIG. 3 (JP-B-6345320: Patent Document 3) does.

On the other hand, as seen from the structures shown in FIGS. 1 and 3, it is not necessary to provide a mass flow controller for controlling the introduction amount of the ammonia decomposition gas. Thus, the costs related to this element can be saved.

Next, regarding the treatment device shown in FIG. 1 (the embodiment of the invention: Example), a range of achievable nitriding potential control was examined. As a result, as shown in the following table 1, it was confirmed that the treatment device shown in FIG. 1 can achieve a wide range of nitriding potential control on a lower nitriding potential side (for example, about 0.1 to 1.5 at 570° C.), which is similar to the treatment device shown in FIG. 3 (JP-B-6345320 (Patent Document 3): Comparative Example). That is to say, the usefulness of the treatment device shown in FIG. 1 was confirmed.

TABLE 1

| | | Set Values | | | | | | | | Measured Values | | | | |
|---|---|---|---|---|---|---|---|---|---|---|---|---|---|---|
| | | Set Nitriding Potential | PID P | PID I | PID D | Temperature | Gas Flow Amount (l/min) NH3 Gas | Gas Flow Amount (l/min) AX Gas | Total Gas | Nitriding Potential | Error | Gas Flow Amount(l/min) NH3 Gas | Gas Flow Amount(l/min) AX Gas | Total Gas |
| Treatment 1 | Example | 1.5 | 6.2 | 133 | 34 | 570° C. | Variable | 2(Constant) | — | 1.5 | 0% | Variable | 2(Constant) | about 58 |
| | Comparative Example | | 7.2 | 120 | 28 | | Variable | Variable | 60 | 1.5 | 0% | Variable | Variable | 60 |
| Treatment 2 | Example | 1 | 6.2 | 133 | 34 | 570° C. | Variable | 5(Constant) | — | 1 | 0% | Variable | 5(Constant) | about 48 |
| | Comparative Example | | 5.3 | 126 | 32 | | Variable | Variable | 50 | 1 | 0% | Variable | Variable | 50 |
| Treatment 3 | Example | 0.7 | 6.2 | 133 | 34 | 570° C. | Variable | 10(Constant) | — | 0.7 | 0% | Variable | 10(Constant) | about 38 |
| | Comparative Example | | 4.7 | 137 | 34 | | Variable | Variable | 40 | 0.7 | 0% | Variable | Variable | 40 |
| Treatment 4 | Example | 0.4 | 6.2 | 133 | 34 | 570° C. | Variable | 15(Constant) | — | 0.4 | 0% | Variable | 15(Constant) | about 33 |
| | Comparative Example | | 4.2 | 154 | 39 | | Variable | Variable | 40 | 0.4 | 0% | Variable | Variable | 40 |
| Treatment 5 | Example | 0.1 | 6.2 | 133 | 34 | 570° C. | Variable | 19(Constant) | — | 0.1 | 0% | Variable | 19(Constant) | about 27 |
| | Comparative Example | | 2.5 | 303 | 76 | | Variable | Variable | 30 | 0.1 | 0% | Variable | Variable | 30 |

According to the control as described above, the in-furnace nitriding potential can be stably controlled in the vicinity of the target nitriding potential. Thereby, the surface hardening treatment of the work S can be performed with extremely high quality. As a specific example, in the example shown in FIG. 4, a feedback control is performed with a sampling rate of about several hundred milliseconds, and each of the introduction amounts of the ammonia gas and ammonia decomposition gas is increased and decreased within a range of about 2 ml (±1 ml) (when the introduction amount of one of those gases is increased, the introduction amount of the other of those gases is decreased), so that the nitriding potential can be controlled to the target nitriding potential (0.7) with extremely high precision since a timing of about 50 minutes after starting the treatment. (In the example shown in FIG. 4, recording of the respective gas introduction amounts and the nitriding potential was stopped at a timing of about 145 minutes after starting the treatment.)

(Comparison Against Comparative Example)

As seen from the graphs shown in FIGS. 2 and 4, when 570° C. is adopted as the temperature condition and the In the gas nitriding treatment around 570° C. (about 560 to 600° C.), the condition of $K_N$=0.1 is a condition in order that no compound layer is generated. The condition of $K_N$=0.2 to 1.0 is a condition in order that the γ' phase is generated as a compound layer. The condition of $K_N$=1.5 to 2.0 is a condition in order that the E phase is generated on a surface. In particular, it is known that the condition of $K_N$=0.3 or the vicinity is a condition in order that the γ' phase (which is important for practical use) can be generated as almost a single phase on a surface.

In addition, as shown in the table 1, regarding the treatment device shown in FIG. 1 (the embodiment of the invention), it was confirmed that it is less necessary (even unnecessary for some cases) to finely change the setting parameter values (the set of "the proportional gain", "the integral gain or the integration time" and "the derivative gain or the derivative time") for the PID control method, depending on different values of the target nitriding potential.

DESCRIPTION OF REFERENCE SIGNS

1 Surface hardening treatment device
2 Processing furnace
3 Atmospheric gas concentration detector
4, 104 Nitriding potential adjustor
5 Temperature adjustor
6 Recorder
8 Stirring fan
9 Stirring-fan drive motor
10 In-furnace temperature measuring device
11 Furnace body heater
13 In-furnace nitriding potential calculator
14, 114 Gas introduction controller
15, 115 Parameter setting device (touch panel)
16 On-off valve controller
17 On-off valve
20 Furnace introduction gas supplier
21 First furnace introduction gas supplier
22 First supply amount controller
23 First supply valve
24 First flow meter
25 Second furnace introduction gas supplier
126 Second supply amount controller
27 Second supply valve
28 Second flow meter
29 Furnace introduction gas pipe
30, 130 Gas flow rate output adjustor
31, 131 Programmable logic controller
40 Exhaust gas pipe
41 Exhaust gas combustion decomposition apparatus

What is claimed is:

1. A surface hardening treatment method comprising:

(i) arranging a work within a processing furnace of a surface hardening treatment device, where the surface hardening treatment device includes:

a) an in-furnace atmospheric gas concentration detector configured to detect a hydrogen concentration or an ammonia concentration in the processing furnace, b) an in-furnace nitriding potential calculator configured to calculate a nitriding potential in the processing furnace based on the hydrogen concentration or the ammonia concentration detected by the in-furnace atmospheric gas concentration detector, and c) a gas-introduction-amount controller configured to increase or decrease an introduction amount of an ammonia gas within a predetermined range of fluctuation while keeping an introduction amount of an ammonia decomposition gas constant, based on the nitriding potential in the processing furnace calculated by the in-furnace nitriding potential calculator and a target nitriding potential, such that the nitriding potential in the processing furnace is brought close to the target nitriding potential, (ii) detecting, by using the in-furnace atmospheric gas concentration detector, a hydrogen concentration or an ammonium concentration in the processing furnace;

(iii) calculating, by using the in-furnace nitriding potential calculator, a nitriding potential in the processing furnace based on the hydrogen concentration or the ammonia concentration detected in said step of detecting a hydrogen concentration or an ammonium concentration in the processing furnace; and (iv) treating the work by introducing an introduction amount of the ammonia gas and an introduction amount of the ammonia decomposition gas into the processing furnace, where the introduction amount of the ammonia gas and the introduction amount of the ammonia decomposition gas introduced into the processing furnace are controlled by said gas-introduction-amount controller, which thereby alters the introduction amount of the ammonia gas within a predetermined range of fluctuation while keeping the introduction amount of the ammonia decomposition gas constant based upon the nitriding potential calculated in said step of calculating a nitriding potential and the target nitriding potential such that the nitriding potential in the processing furnace is brought close to the target nitriding potential.

2. The surface hardening treatment method according to claim 1, wherein the gas-introduction-amount controller is configured for a plurality of surface hardening treatments for a work, and wherein the target nitriding potential is different for each of the respective surface hardening treatments within the plurality of surface hardening treatments, and wherein the target nitriding potential is constant within each of the respective surface hardening treatments of the plurality of surface hardening treatments.

3. A surface hardening treatment device for performing a gas nitriding treatment as a surface hardening treatment for a work arranged in a processing furnace by continuously introducing an ammonia gas and an ammonia decomposition gas, the surface hardening treatment device comprising an in-furnace atmospheric gas concentration detector configured to detect a hydrogen concentration or an ammonia concentration in the processing furnace, an in-furnace nitriding potential calculator configured to calculate a nitriding potential in the processing furnace based on the hydrogen concentration or the ammonia concentration detected by the in-furnace atmospheric gas concentration detector, and a gas-introduction-amount controller configured to increase or decrease an introduction amount of the ammonia gas within a predetermined range of fluctuation while keeping an introduction amount of the ammonia decomposition gas constant, based on the nitriding potential in the processing furnace calculated by the in-furnace nitriding potential calculator and a target nitriding potential, such that the nitriding potential in the processing furnace is brought close to the target nitriding potential.

4. The surface hardening treatment device according to claim 3, wherein the gas-introduction-amount controller is configured for a plurality of surface hardening treatments for a work, and wherein the target nitriding potential is different for each of the respective surface hardening treatments within the plurality of surface hardening treatments, and wherein the target nitriding potential is constant within each of the respective surface hardening treatments of the plurality of surface hardening treatments.

5. The surface hardening treatment device according to claim 3, wherein the introduction amount of the ammonia gas is increased or decreased by means of a mass flow controller, and the introduction amount of the ammonia decomposition gas is increased or decreased by means of a manual flow meter.

* * * * *